US008782982B2

(12) United States Patent
Lewis

(10) Patent No.: US 8,782,982 B2
(45) Date of Patent: Jul. 22, 2014

(54) RADIANT THERMAL BARRIER

(76) Inventor: David L. Lewis, Bethlehem, CT (US)

( * ) Notice: Subject to any disclaimer, the term of this patent is extended or adjusted under 35 U.S.C. 154(b) by 371 days.

(21) Appl. No.: 13/101,331

(22) Filed: May 5, 2011

(65) Prior Publication Data

US 2011/0271626 A1 Nov. 10, 2011

Related U.S. Application Data

(60) Provisional application No. 61/395,120, filed on May 7, 2010.

(51) Int. Cl.
*E04B 1/74* (2006.01)

(52) U.S. Cl.
USPC ..... 52/407.3; 52/404.3

(58) Field of Classification Search
USPC ..... 52/407.1–407.3, 98, 105, 404.1, 404.3, 52/407.4
See application file for complete search history.

(56) References Cited

U.S. PATENT DOCUMENTS

| | | | | |
|---|---|---|---|---|
| 2,887,733 | A * | 5/1959 | Kice | 52/143 |
| 3,251,382 | A * | 5/1966 | Tatsch | 138/151 |
| 6,185,895 | B1 * | 2/2001 | Rettew | 52/528 |
| 6,346,040 | B1 * | 2/2002 | Best | 454/260 |
| 6,754,995 | B1 * | 6/2004 | Davis et al. | 52/95 |
| 7,900,682 | B2 * | 3/2011 | Calvino, Jr. | 160/232 |
| 2004/0163345 | A1 * | 8/2004 | Alderman | 52/404.1 |
| 2005/0153092 | A1 * | 7/2005 | Lewis | 428/54 |
| 2009/0126302 | A1 * | 5/2009 | Thomas | 52/407.3 |

* cited by examiner

*Primary Examiner* — William Gilbert
(74) *Attorney, Agent, or Firm* — Ware, Fressola, Maguire & Barber LLP

(57) ABSTRACT

A thermal barrier is formed into a hat-shape by folding sections of an extended length of board formed for assembly and insertion as a barrier to thermal radiation into a space between two joists or studs of a floor, wall, roof, or ceiling of a building for completely covering the space while also covering protruding edges of the joists or studs so as to reduce thermal energy transfer through the joists or studs themselves. A thermal barrier assembly is shown with an outer reflective surface and is also shown for assembly into a form having an inner enclosure for enclosing an inner thermal barrier also having a reflective surface for reducing thermal radiation transfer by reflection and protected from dust by virtue of the enclosure.

11 Claims, 4 Drawing Sheets

RADIANT THERMAL BARRIER

BACKGROUND OF THE INVENTION

The present invention relates to a thermal transfer barrier and, more particularly, for use in construction to help control energy flow into and out of homes and buildings.

Heat transfer through building structures occurs through convection conduction and radiation. In order to retard heat flow by conduction and convection, exterior walls and roofs are built with interior walls, floors, and ceilings having internal air spaces in between. Conduction and convection through the air spaces combined represents only 20 to 35 percent of the heat which passes through them. In both winter and summer 65 to 80 percent of the heat that passes from a warm wall to a colder wall or through a ventilated attic does so by radiation.

Radiant barrier materials may be formed of aluminum foil laminates in which the foil is laminated to kraft paper, cardboard, plastic films or to OSB/plywood roof sheathing. Another variation is aluminized plastic films comprising a thin layer of aluminum particles deposited on film through a vacuum process. In both cases, the heat reflective insulation is provided by low emittance surfaces bounding one or more enclosed air spaces. For a basement, below a reflective radiant thermal barrier material placed under the floor, fiberglass or other similar kinds of insulation may be placed between the joists to reduce heat transfer between the cavity and the cooler space below. Similar barriers are used for walls and roofs.

A typical way to try to create an air cavity for instance between a pair of overhead joists is to loosely place a layer of aluminum foil on top of fiberglass and push the fiberglass with aluminum foil loosely lying on top into the joist bay but not all the way in so as to try to leave a small air space, with the aluminum foil facing the floor board so that radiant heat coming from the floor and inside the cavity reflects back off the aluminum foil toward the floor board rather than toward the basement. The fiberglass insulation resists additional heat loss through convection and conduction toward the basement.

A problem with this method of installation of a radiant reflective barrier, particularly for heated floors, is that it is not easy to judge the proper amount of insertion of the insulation so as to maintain at least three-quarters to one inch of air space needed to create a proper air cavity between a pipe attached to the underside of the floor and the reflective foil lying on top of the fiberglass batting below. A similar problem exists between studs in forming an air cavity for the same or any similar purpose for a wall or a ceiling or for forming a cavity between roof joists and an attic even if they are not heated.

In U.S. patent application Ser. No. 12/404,542 filed Mar. 16, 2009, fan-folded panels were disclosed for transport in convenient sized blocks to a construction site. The panels are unfolded and cut to fit an extended length between two joists. The extended panels are provided with longitudinal cuts or fold lines along the extended length of the panels to enable folding of edge sections of the panels to form channel walls on either side of an intermediate panel section. Together they form a channel having a heat reflective surface inside the channel. The so-formed channel was shown for insertion between two facing joists or studs so that tops of the channel walls were shown for being pushed up against a facing surface supported by the joists to form an air cavity between the facing surface and the channel acting as the radiant thermal barrier. In this way, an air cavity is easily regularized at a proper depth with the radiant thermal barrier deployed over the whole of the basement, ceiling or wall to be insulated. Additional barrier material such as a layer of fiberglass batting may be fastened onto the outside of the intermediate panel to further block thermal transfer. The resultant radiant thermal barriers very much help control energy flow into and out of such spaces within homes and buildings.

Tests to date have shown that in attics with R-19 insulation, radiant thermal barriers can reduce summer ceiling heat gains by about 16 to 42 percent compared to an attic with the same insulation level and no radiant barrier. These figures are for the average reduction in heat flow through the insulation path. They do not however include effects of heat flow through the framing members.

Moreover, the effectiveness of radiant barriers changes as a result of dust and contamination accumulation on its surfaces. Dust accumulates because it travels with ventilation within an attic or within a building structure. The amount of dust accumulation varies with ventilation flow rate, type of flow arrangement and building location.

SUMMARY OF INVENTION

It is an object of the invention to provide a radiant thermal barrier that is easy to install and provides a consistent air space without difficulty.

Another object of the invention is to provide a method for creating a radiant insulating barrier system where low emissivity radiant barrier surfaces of the system are protected from dust and contamination accumulation.

Still another object is to allow for the addition of multiple layers of reflective insulation layers in order to enhance the thermal efficiency of the system where the additional interior layers of radiant barriers are protected from detrimental surface contamination.

Yet another object of the invention is to reduce negative conductive energy transfer via framing components.

According to a first aspect of the present invention, a thermal barrier comprising an extended length of board formed for assembly and insertion as a barrier to thermal radiation into a space between two joists or studs of a floor, wall, roof, or ceiling of a building for completely covering the space while also covering protruding edges of the joists or studs.

In further accord with the first aspect of the present invention, the extended length of board formed for assembly into an enclosure for containing a thermal radiation barrier and for providing protection from accumulation of dust on the thermal radiation barrier. The contained thermal barrier may include a reflective surface on an outside face of the contained thermal barrier for facing the floor, wall, roof, or ceiling from outside the enclosure.

In still further accord with the present invention, the thermal barrier may include a reflective surface on a face of the thermal barrier for facing the floor, wall, roof, or ceiling.

In accordance still further with the present invention, the extended length of board may have a plurality of fold lines spaced along the extended length for folding the extended length of board into a channel for the insertion into the space between the joists or studs with edges of the channel lying on the protruding edges for attachment thereto, the extended length of board having a fold line for folding into a lid for covering a space within the channel enclosing a radiant heat barrier placed inside the space within the channel.

According to a second aspect of the present invention, a thermal barrier comprises an extended length of board formed for assembly into an enclosure for enclosing a thermal barrier having a reflective surface for facing an air cavity formed between the thermal barrier and a facing building surface and formed between two facing building joists or studs from inside said enclosure, the air cavity having a length corresponding to the extended length of board.

The thermal barrier with the extended length of board for the assembly into the enclosure for insertion in between the two facing building joists or studs, according further to the second aspect of the invention, may be for completely covering a space between the two building joists or studs and may be for completely covering protruding edges of the joists or studs.

The thermal barrier according to the second aspect may further comprise a reflective surface on an outside face of said enclosure for facing said air cavity from outside said enclosure.

According to a third aspect of the present invention, a thermal barrier comprises an insulating material foldable into a hat shape for insertion between two facing joists or studs to form an air cavity between the thermal barrier and a facing floor, wall, ceiling, or roof, the insulating material in said hat shape having (a) a hat top side for said facing the floor, wall, ceiling, or roof, (b) hat sides for facing said facing joists or studs, and (c) hat brim sides for facing protruding edges or edge faces of said joists or studs, said hat top having a reflective surface for reflecting thermal energy radiated from said floor, wall, ceiling, or roof back toward said floor, wall, ceiling, or roof, and said hat brim sides for reflecting, blocking, or both reflecting and blocking thermal energy radiated, conducted, or both radiated and conducted from said floor, wall, ceiling, or roof via said joists or studs.

In further accord with the third aspect of the invention, the insulating material may further comprises a hat cover for forming an enclosed space along with the hat top side and the hat sides for enclosing insulating material within the enclosed space for providing an additional thermal barrier to thermal energy. The insulating material may have a reflective surface facing the hat top side for reflecting thermal energy radiated from the floor, wall, ceiling, or roof and protected from accumulation of dust by enclosure within the enclosed space.

These and other objects, features and advantages of the present invention will become apparent in light of the detailed description of a best mode embodiment thereof as illustrated in the accompanying drawing.

DETAILED DESCRIPTION OF THE ILLUSTRATED EMBODIMENT

Figure 1:
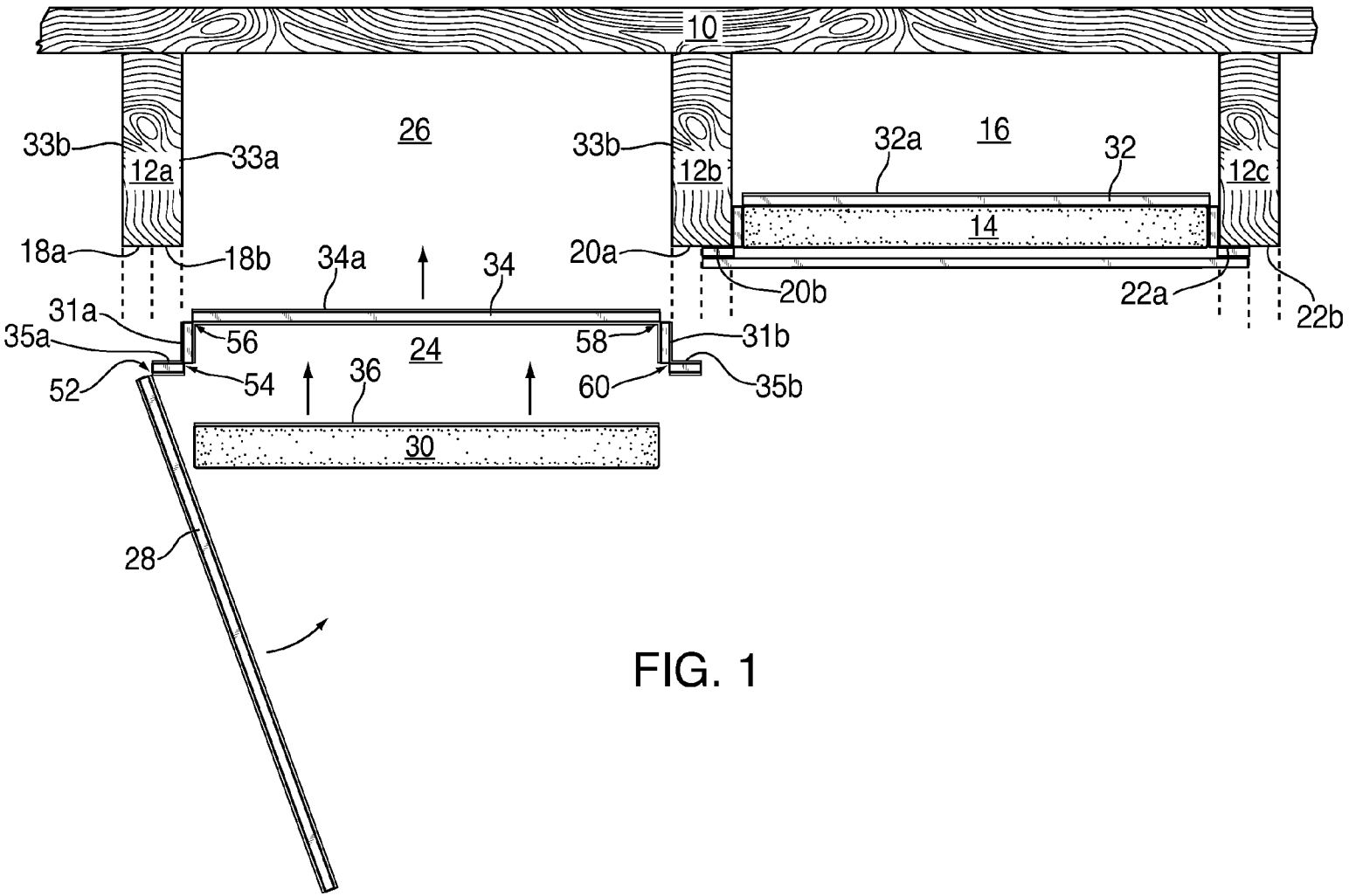
FIG. 1 shows a side view (not to scale) of a plurality of joists or studs attached to a floor, ceiling, wall or roof of a building having a thermal barrier inserted between the joists or studs, according to the present invention.

Reference numeral 10 of FIG. 1 shows a sectional view of a floor, ceiling, wall, or roof of a building supported by a plurality of joists 12*a*, 12*b*, 12*c*.

A hat-shaped thermal barrier assembly 14 is shown inserted as a barrier to thermal radiation from e.g. above the floor 10 and conducted through the floor into a space 16 between these joists or studs 12*b*, 12*c* in such a way that the thermal barrier assembly completely covers the space 16 while also covering a half portion 20*b*, 22*a* of edge faces of the joists or studs 12*b*, 12*c*. Each edge face comprises two half portions 20*a*, 20*b* extending longitudinally along the length of the edge face of the joist, i.e., in a direction perpendicular to the drawing sheet.

On the left hand side of FIG. 1 a thermal barrier assembly 24 is shown during the assembly process, after having been folded into the shape shown from an extended length of board (see FIG. 5), which has been previously unfolded, and cut to length for such assembly at a construction site. The barrier assembly 24 is shown lined up for insertion into a space 26 between joists or studs 12*a*, 12*b*. It is shown having a lid 28 in an open position so as to permit insertion of an inner thermal barrier 30 e.g. in the form of a panel inside the thermal barrier assembly 24 before closing the lid 28. The inner thermal barrier 30 may be assembled in stages by inserting parts thereof, or as one piece, as explained in more detail below. Once the thermal barrier 30 is inserted within the thermal barrier 24, the lid 28 is closed, the entire assembly is inserted in the space 26 (in a similar position as that shown by the thermal barrier assembly 14 on the right hand side of FIG. 1) and is attached to the joists or studs 12*a*, 12*b* with fasteners (such as staples applied by a staple gun) that may be used to fasten the outer edge portions of the thermal barrier to the protruding edge faces of the joists or studs on the covered half edge face portions 18*b*, 20*a*. Left and right channel walls 31*a*, 31*b* slide into the cavity 26 against the respective left and right inner flat surfaces 33*a*, 33*b* of the space's left and right joists 12*a*, 12*b* and remain in place abutting the inner walls 33*a*, 33*b* of the cavity formed by the respective flat surfaces 33*a*, 33*b* of the joists. Left and right edge parts 35*a*, 35*b* of the assembly form the "brim" of the hat-shaped assembly 24. The illustrated sectional view of the assembly resembles a section of an old-fashioned straw boater hat brought to America by Italian immigrants. It was worn by the Gondoliers of Venice and became very popular in late $19^{th}$ and early $20^{th}$ century America as summer headgear made of sennit straw with a stiff flat crown and brim.

Surfaces 32, 34 of the thermal barrier assemblies 14, 24 may be provided with pre-applied thermal reflective barrier laminate surfaces (shown by thin laminar layers 32*a*, 34*a* on top) such as aluminum foil with the shiny side up so as to act as thermal radiation barriers within the cavities 16, 26 so as to reflect energy emanating from the floor, ceiling, wall or roof back toward the direction from which it came for conduction through e.g. the floor 10 back into the space above.

In addition, each of the thermal barrier assemblies 14, 24 may have an inner thermal barrier such as the illustrated inner thermal barrier 30 placed inside that may additionally include an additional reflective thermal radiation laminar barrier 36 pre-applied on a surface thereof. By virtue of being enclosed within the thermal barrier assemblies 14, 24, the inner barrier 30, and especially its reflective surface, will be protected against accumulation of dust and therefore retain its ability to reflect thermal radiation without interference from dust accumulation, at least not to the extent that the reflective surfaces 32*a*, 34*a* will be exposed to accumulation of dust.

As suggested above, from the sectional view pictured in FIG. 1, the thermal barrier assemblies 14, 24 can be viewed in the sectional view as hat-shaped thermal barriers having a top 32, 34, sides 31*a*, 31*b* that lie adjacent the inside flat surfaces 33*a*, 33*b* of the facing joists so as to abut same and a brim 35*a*,

35*b* that lies against the protruding edge faces 20*b*, 22*a* of the facing joists or studs, also in abutting fashion.

Figure 2:
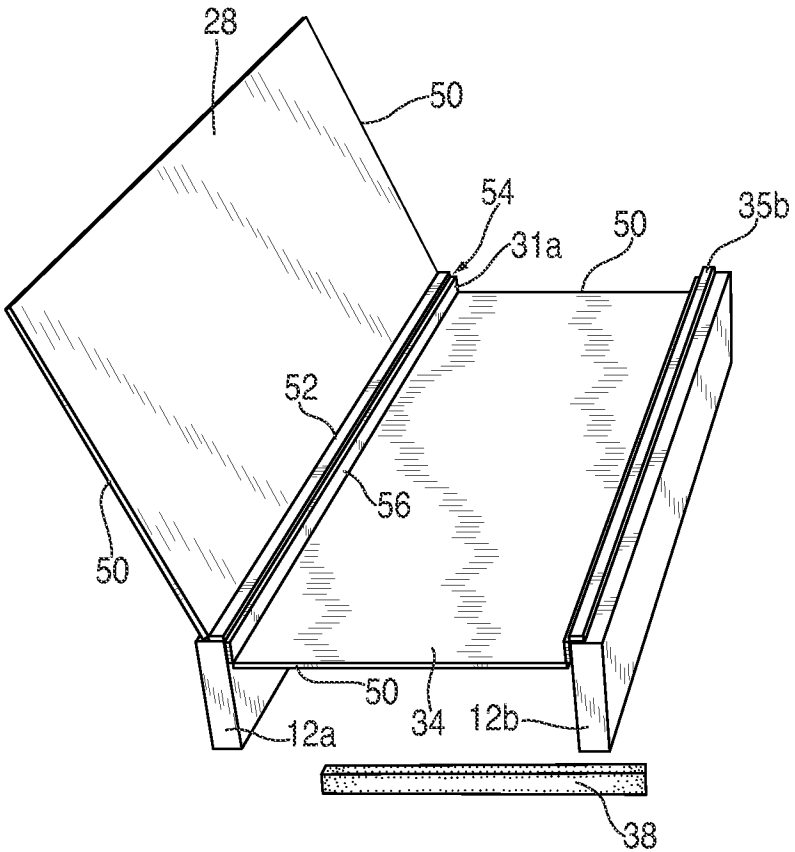
FIG. 2 shows two of the joists or studs of FIG. 1 in a perspective view showing the thermal barrier of the present invention during the assembly process.

FIG. 2 shows the joists or studs 12*a*, 12*b* of FIG. 1 in a perspective view with the lid 28 in the open position, as on the left hand side of FIG. 1, in a position receptive to insertion of the inner thermal barrier 30 in the form of a panel within a channel formed by the folded assembly of the extended length of board. It should be realized that the perspective view of FIG. 2 (as well as FIGS. 3 and 4) is flipped one hundred and eighty degrees so as to be upside down from the particular floor embodiment of FIG. 1. Although the inner thermal barrier 30 for insertion in the channel is not shown in FIG. 2, an insulation cover 38 e.g. in the form of an end piece or plug is shown which is used to cover an end of the assembly so as to close off or plug the enclosed space with the inner thermal barrier 30 inserted inside to form an insulation cover as an end piece of the barrier assembly 24. A similar insulation cover 38 would be placed at the other end of the assembly 24 of FIG. 2 to completely cover, plug or close up the assembly with the inserted thermal barrier 30 inside the enclosed space within the assembly 24. The end covers 38 are placed at the end openings so as to act as end pieces shaped to cover, close or plug the end openings and tend to prevent or at least reduce the flow of air in and out of the cavity after the lid is closed and the assembly fastened in place. The lid 28 is then closed and the entire assembly 24 is fastened to the joists or studs on either side. It should be mentioned that after inserting the thermal barrier 30 inside the assembly 24, it may be covered with an additional panel before closing the lid.

Figure 3:
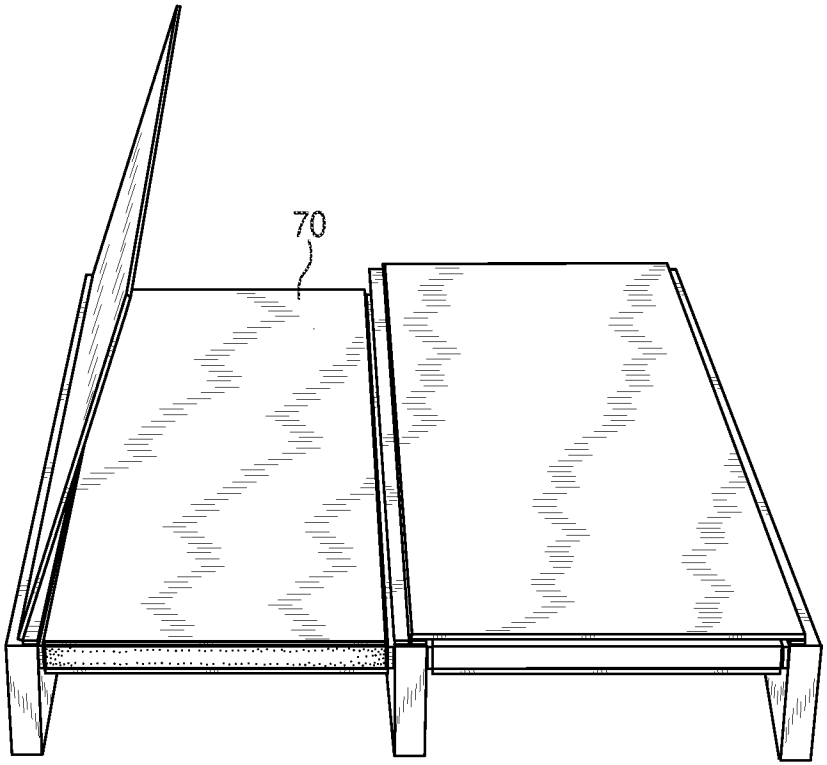
FIG. 3 is a perspective view of the joists or studs of FIG. 1 with a thermal barrier according to the present invention assembled between two of the studs and another thermal barrier according to the invention still undergoing the assembly process according to the present invention.

Such an additional panel 70 is shown on the left hand side of FIG. 3 which shows the situation of FIG. 1 with one thermal barrier assembly 14 already completed on the right and inserted in place and the other on the left in the state of assembly with the lid still open. The additional panel 70 may have a reflective surface on one side and be placed in the enclosed space so the reflective surface will be facing the floor, roof or ceiling 10 after assembly and insertion.

Figure 4:
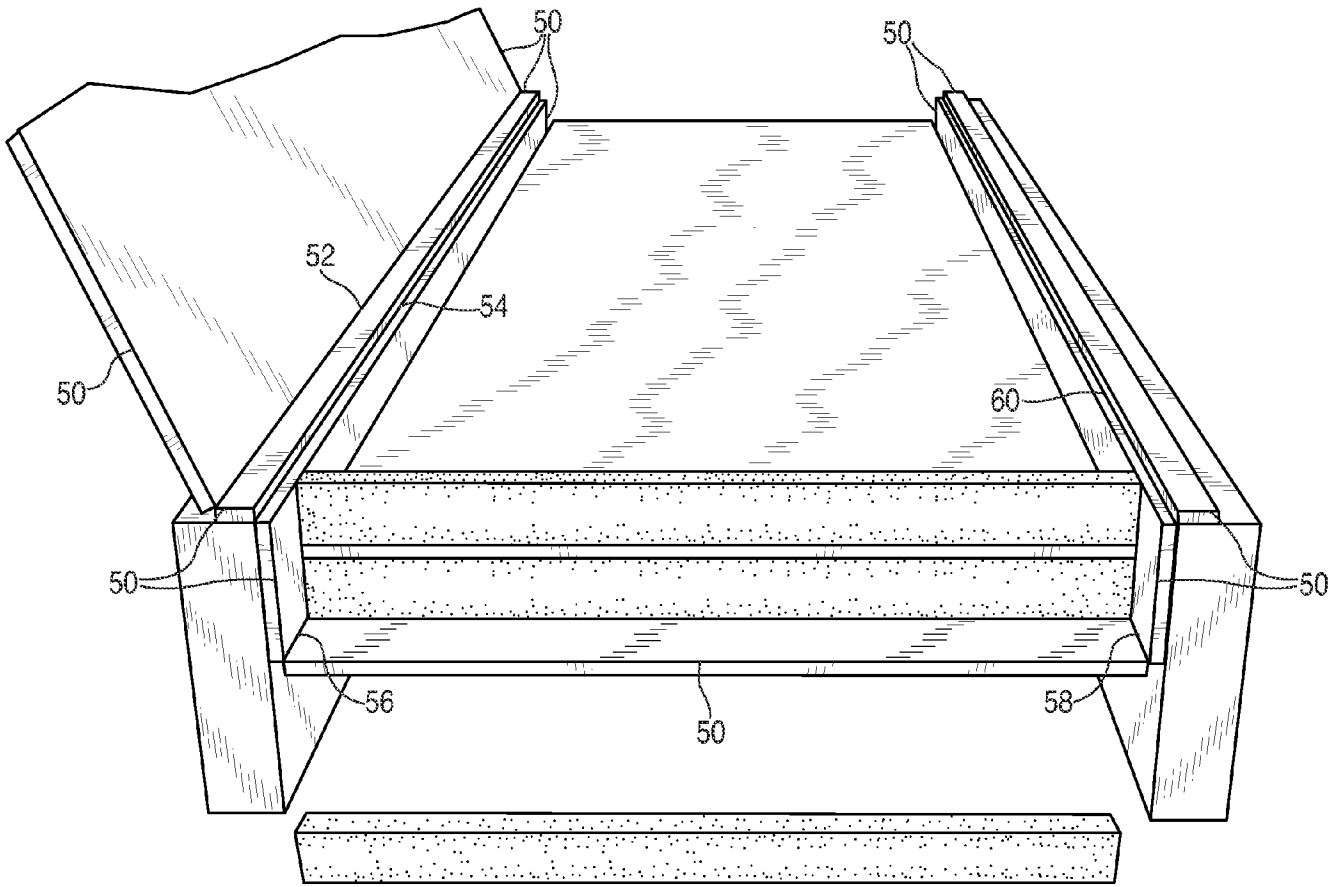
FIG. 4 shows another perspective view of a thermal barrier, according to the present invention, during the assembly process.
Figure 5:
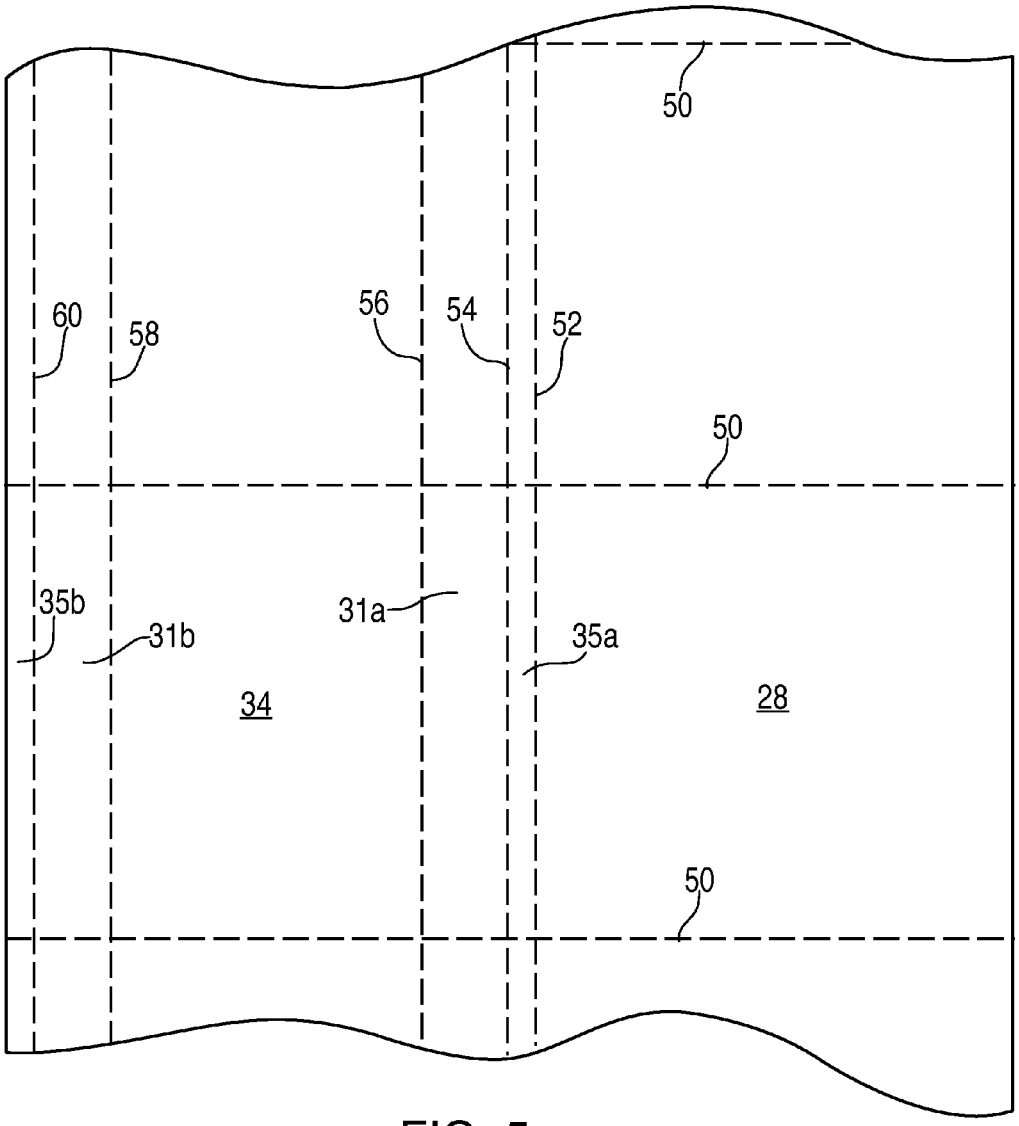
FIG. 5 is a plan view (not to scale) of a thermal barrier shown extended in length and showing fold lines, both transverse and longitudinal.

Referring back to the embodiment of FIG. 2, the lid 28 has a length cut from a bigger panel such as shown in FIG. 5 that is shown in correspondence to the illustrated length of a section of the pair of facing joists 12*a*, 12*b*. The illustrated length corresponds to the length of a fold line 52 between two parallel fold lines 50 shown also in FIGS. 1 and 5 along a hinge of the panel 28. A section of insulation may be cut by cutting along two parallel lines 50, in FIG. 5, as appropriate. The hinge may be formed by cutting through the top laminate 34*a* and the panel material 28 along the fold line 52 while not cutting through the laminate on the underside of the panel 28 (at best shown at reference numeral 52 in FIG. 1). The uncut laminate on the underside thus acts as a hinge for the panel section 28 shown in FIGS. 1 and 2. Similarly, another hinge is formed along cut-line 54 shown in FIGS. 1, 2 and 5 by cutting through the underside (see FIG. 1) laminate and the panel material but not cutting through the top side laminate between sections 31*a* and 35*a*. Another hinge 56 is shown in FIG. 1 and FIG. 2 and is made by cutting through the top side laminate and the panel material but not the underside laminate. A similar situation exists on the right hand side of the assembly 24 of FIG. 1 with hinges formed along lines 58 and 60 as shown also in FIG. 5. It should be understood from the views shown in FIGS. 2-4 that the hat shape (resemblance to the cross section of the hat as described above) is a side view of what is essentially a rectangular-shaped "thick" panel assembly situated on top of a "thinner" panel 28 and the folded sections 31*a*, 35*a*, 31*b* and 35*b*. As such, the side view of FIG. 1 is a side view of a wider panel extending between the center lines of the joists as shown on the right hand side of FIG. 1 supporting a narrower width panel 14 fitting snugly (along with the sections 31*a*, 31*b*) horizontally between the joists and extending the same longitudinal length along the length of the panel section such as shown in FIG. 2 by the length of the cut line 52 between two successive parallel cut lines 50.

FIG. 4 shows that a double layer of reflective insulation may be provided e.g. as panels in a double depth inner thermal barrier embodiment so as to increase the effectiveness of the entire thermal barrier assembly. Two insulation panels, each with a reflective layer on a top surface thereof facing in a downwards direction in FIG. 4 are layered on top of each other to fill the cavity. As in FIG. 3, this embodiment could also utilize an additional thinner reflective panel added on top of the double layer of inserted thermal barriers before closing the lid and before inserting the end piece insulation covers 38 acting as plugs at each end.

FIG. 5 shows in plan view (not to scale) what is shown on the left hand side of FIG. 1, i.e., a thermal barrier assembly 24 comprising an extended length of board formed for assembly and insertion as a barrier to thermal radiation into the space 26 between the two joists shown on the left hand side supporting a floor 10 which could of course instead be two studs supporting a wall, roof or ceiling of a building. The thermal barrier is shown in its extended form after having been unfolded from its shipping form in which it is in a compact, folded condition, in which it was folded for instance at the factory for packaging and transport to a construction site. In the factory, panels would be folded along cut lines or folding lines 50 for folding successively in opposite directions so as to form a stack for compact transport to a construction site. See the above mentioned co-pending U.S. patent application Ser. No. 12/404,542 published as U.S. Patent Application Publication No. 2010/0229487 on Sep. 16, 2010 for a similar transport block. The stack would be rectangular in shape and contain many more layers than pictured in FIG. 5 so as to form a rectangular block of folded panels made e.g., of synthetic resin foam board with laminar reflective skin (such as metal foil) adhered to each planar surface thereof. The cut lines cut through panel but only one of the opposing laminar skins so as to form convenient hinges with the uncut skin. A block form is easily packaged and transported and once it arrives at the construction site, the outer packaging may be removed and the planar sections unfolded along the lines 50 into a flat length of board as shown in FIG. 5 and suitable to extend along a sectional part or whole of the entire length of a bay between the joists or the studs to be insulated. This could be done by unfolding the block of sections to form an extended board and cutting the extended board to size before carrying out the operation shown in FIG. 1 so as to be readily insertable by one or more construction workers using fasteners to affix the entire length of the extended board in one section or in multiple sections between the two facing joists (if shorter lengths are cut). The ends of such shorter lengths would be plugged with end insulation covers 38. It should be realized, however, that the barrier assembly 24 of FIG. 1 may be assembled from a single panel that is not folded but rather merely stacked. In that case, the radiant thermal barrier 24 would be of some convenient length, e.g., four feet long, and several radiant thermal barriers would be laid along the cavity of the bay between the studs, joists or rafters with end insulation cover 38 in between.

Besides the transverse folding or cut lines 50, also shown are a plurality of longitudinal folding or cut lines provided in the panels to assist the construction workers in folding the panels into the thermal barrier assembly with a hat shaped cross-section as shown in the other figures. For instance, assuming the illustrated plane is rotated one hundred and eighty degrees in the plane of the page and then rotated ninety degrees upwards (out of the page) toward the reader and viewed edgewise so as to be ready for folding as in FIG. 1, in order to form a hinge for the lid 28, a cut line or folding line 52 is provided for hinged folding in a manner similar to the counterclockwise direction shown in FIG. 1. A nearby folding or cut line 54 then permits hinged folding of the panel brim section between lines 52 and 54 in the clockwise direction to help form the "brim" 35*a* of the hat-shaped assembly 24. This would be a left-brim-part of the side view of the hat shaped assembly 24 of FIG. 1. The next fold or cut line 56 enables hinged folding a section between lines 54 and 56 in the counterclockwise direction to form the channel wall section 31*a* of the hat-shaped assembly. A next fold or cut line 58 on the other side of the "top" of the hat-shaped assembly 24 permits hinged folding in the clockwise direction to form the channel wall section 31*b* out of a section between lines 58 and 60. Finally, the fold or cut line 60 permits the panel to be folded about a hinge formed by the uncut laminate on the top in a counterclockwise direction to form the right-hand side "brim" section 35*b* of the hat-shaped assembly 24.

The transverse and longitudinal fold or cut lines shown in FIG. 5 may be made in any number of different ways, for instance by folding lines pressed into the surface of the material such as by means of a heated die, for example, with a v-shaped knife edge or even a rounded edge. By compressing a lightweight construction material such as cardboard with such a die, the folding lines would in such a case not actually constitute cuts in the material but would rather merely be impressed into the material to facilitate folding and unfolding, as appropriate at the construction site. Such an embodiment would not require laminate on both sides of the panel. On the other hand, cuts may be particularly useful in cases, such as shown in FIG. 1, where there are laminar skins on both sides of the panel. In that case, the folding lines may constitute cuts, but cuts not made all the way through the panel or board, i.e. only to a depth that is short of the protective film or laminar skin on the opposite surface. Such might be used if foam board is used. Instead of cuts or impressed fold lines, the surfaces may be scored on particular surfaces so as to permit hand-breaking of the scored surface along the scored line as appropriate.

For a cardboard or similar material embodiment, as mentioned above, a v-shaped knife edge or even a rounded edge die or heated die could be used to press into the surface of the material to create folding lines. An example of such a folding line is shown for instance in FIG. 5*a* of co-pending application Ser. No. 12/404,542 filed Mar. 16, 2009 and published under U.S. Patent Application Publication No. 2010/0229487 on Sep. 16, 2010. Thus, using such a concept, the folds shown in FIG. 1 hereof would be facilitated by v-shaped impressions in the cardboard instead of cut lines for folding in a manner similar to the openings of the hinges 52, 54, 56, 58, and 60 of FIG. 1 hereof. The thermal barrier assemblies 14, 24 of FIG. 1 as explained above, have the feature of being able to completely cover the space in the cavities 16, 26 while at the same time also covering protruding edges or end faces 18*a*, 18*b* of joists or studs 33*a*, 33*b* to assist in retarding heat from the space above conducted through the floor 10 and then through the joists 12*a*, 12*b* from being radiated through the edge faces 18*a*, 18*b* and 20*a*, 20*b* into the basement, such as shown in FIG. 1. The thermal barrier of the present invention thus provides a thermal radiation barrier and provides moreover for protection from accumulation of dust on the thermal radiation barrier. Such may take the form of one or more reflective surfaces on inside 36, outside 34*a*, or both inside and outside faces of the assembly 14, 24 for facing the floor, wall, roof, or ceiling 10.

The extended length of board or adjoining panels have a plurality of longitudinal and transverse fold or cut lines spaced along the extended length for folding the extended length of board into a hat-shaped channel (as shown from a side view in FIG. 1) for insertion into the space 16, 26 between the joists or studs with edges 31*a*, 31*b* of the channel abutting the opposing flat surfaces of 33*a*, 33*b* of the joists and constituting brim sections 35*a*, 35*b* of the "hat" lying on the protruding edges or end faces of the supporting joists for attachment thereto. As mentioned above, the "brim" sections 35*a*, 35*b* cover the edge face halves 18*b*, 20*a*, respectively, of the joists 12*a*, 12*b* and have reflective surfaces for reflecting heat conducted downward through the joists 12*a*, 12*b* from the space above the floor 10 back through the joists and floor for radiation into the space above the floor in order to at least partially prevent heat from radiating out of the joist edges into e.g. the basement below. The extended length of board may have a fold or cut line 52 for folding a section as a lid 28 for covering a space within the channel enclosing an inner radiant heat barrier 30 placed inside the space within the channel.

Thus, the thermal barrier assembly 24 is made from an extended length of board formed for such assembly into the enclosure 26 and may itself enclose an inner thermal barrier 30 having a reflective surface 36 for facing an air cavity 26 formed between the thermal barrier assembly 24 and a facing building surface 10 and formed between two facing support members such as building joists 12*a*, 12*b* or studs from inside the enclosure. The air cavity 26 has a length corresponding to the extended length of the board section e.g. corresponding to the length of the fold or cut line 52 shown in FIG. 2 and may be plugged by a cover 38 as an end piece at each end. By virtue of the brim-sections 35*a*, 35*b*, the extended length of board for the assembly 24, after insertion in between the two facing building joists or studs, completely covers not only the space between the two building joists or studs but also covers completely the protruding edges or edge faces or parts thereof 18*b*, 20*a* of the joists or studs on opposite sides of the space therebetween and may also be provided with a heat reflective surface. Thus, the thermal barrier assembly 24 may also have a reflective surface 34*a* on an outside face thereof for facing the air cavity 26 from outside the assembly. Of course, as explained above, the inner thermal barrier 30 may include one or more extended panel layers, each of which may be provided with a reflective surface facing in the same direction and which moreover are protected from dust by virtue of being contained within the assembly of the present invention.

Thus, the present invention shows how to make a thermal barrier assembly 14 from insulating material foldable into a shape that has a hat-shaped cross-section for insertion between two facing joists or studs to form an air cavity 16 between the thermal barrier assembly and a facing floor, wall, ceiling, or roof 10 and plugged at the ends with insulation covers 38 as end pieces or plugs. The insulating material having the hat shape cross-section has (a) a hat top side 32 for facing the floor, wall, ceiling or roof, (b) hat sides 31*a*, 31*b* for facing the opposing faces 33*a*, 33*b* of the joists or studs, and (c) hat brim sides 35*a*, 35*b* for facing protruding edges or edge faces of the joists or studs, at least in part. The hat top of such an assembly may be provided with a reflective surface for reflecting thermal energy radiated from the floor, wall, ceiling or roof 10 back toward the floor, wall, ceiling or roof and the hat brim sides are for reflecting, blocking or for both reflecting and blocking thermal energy conducted from the floor, wall, ceiling or roof via the joists or studs back toward the floor, wall, ceiling or roof.

The thermal barrier assembly may include a hat cover 28, as shown in the cross-sectional view of FIG. 1 and in perspective in FIG. 2, for forming an enclosed space formed along with the hat top side and the hat sides so as to form an enclosure for enclosing an inner thermal barrier within an enclosed space within the assembly for providing an additional thermal barrier to thermal energy. The inner thermal barrier may include a reflective surface facing the hat top side for reflecting thermal energy radiated from the floor, wall, ceiling, or roof and by virtue of being inside the assembly, being protected from accumulation of dust by enclosure therein.

Although the invention has been shown and described with respect to a best embodiment thereof, it should be understood by those skilled in the art that the foregoing and various other changes, omissions and deletions in the form and detail thereof may be made therein without departing from the spirit and scope of the invention.

The invention claimed is:

1. A thermal barrier comprising a radiant heat barrier and an extended length of board deliverable unassembled to a building site, said extended length of board formed for on-site assembly into a channel having a lid covering an open side of said channel to form an enclosure for enclosing said radiant heat barrier, said assembled thermal barrier for insertion as a barrier to thermal radiation into a space between two joists or studs of a floor, wall, roof, or ceiling of said building for completely covering said space while also at least halfway covering protruding edges of said joists or studs, said extended length of board having a plurality of fold lines spaced along said extended length for folding said extended length of board into said channel for said insertion into said space between said joists or studs with edges of said channel lying on said protruding edges for attachment thereto, said extended length of board having a fold line for folding into said lid for covering said open side of said channel to form said enclosure for enclosing said radiant heat barrier placed inside said channel, said radiant heat barrier comprising a reflective surface on an inside face for facing said floor, wall, roof, or ceiling from within said enclosure, said enclosure for providing protection from accumulation of dust on said reflective surface on said inside face of said radiant heat barrier contained in said enclosure, said thermal barrier further comprising a reflective surface on an outside face of said enclosure for facing said floor, wall, roof, or ceiling from outside said enclosure.

2. The thermal barrier of claim 1, wherein said radiant heat barrier and said extended length of board comprise plastic foam.

3. The thermal barrier of claim 2, said board provided with pre-applied laminar skins on opposing sides of said board, said fold lines comprising lines cut through the extended length of board but only one of the opposing laminar skins so as to form hinges with the uncut skins.

4. The thermal barrier of claim 1, wherein ends of said lid form an outer layer covering inner layers of said board covering said protruding edges of said joists or studs so as to cover said protruding edges with a double layer of foam.

5. The thermal barrier of claim 1, wherein said fold lines comprise five parallel longitudinal fold lines prefabricated along said extended length and a plurality of transverse fold lines perpendicular to said longitudinal fold lines.

6. An extended length of foam board having a plurality of parallel fold lines spaced apart and aligned along said extended length, wherein said fold lines comprise at least five parallel longitudinal fold lines prefabricated along said extended length defining lines between sections of said extended length of foam board, said sections foldable at a building site into a thermal barrier having a hat shape enclosing a space within said thermal barrier.

7. The board of claim 6, comprising pre-applied laminar skins on opposing sides of said board, said fold lines comprising lines cut through the extended length of board but only one of the opposing laminar skins so as to form hinges with the uncut skins.

8. The board of claim 6, wherein said fold lines further comprise a plurality of transverse fold lines perpendicular to said longitudinal fold lines and said board is foldable or unfoldable about successive transverse fold lines in opposite directions.

9. The board of claim 6, further comprising a radiant thermal barrier for insertion inside the space formed within said thermal barrier during assembly wherein said radiant thermal barrier has a reflective surface for facing a crown section of said thermal barrier having said hat shape.

10. The board of claim 6, wherein said longitudinal fold lines comprise a first longitudinal fold line dividing a first brim section and a first side section, a second longitudinal fold line dividing said first side section and a crown section, a third longitudinal fold line dividing said crown section and a second side section, a fourth longitudinal fold line dividing said second side section and a second brim section, and a fifth longitudinal fold line dividing said second brim section and a lid section, wherein said sections divided by said first, third, and fifth longitudinal fold lines are foldable in a first rotational direction about the respective first, third, and fifth longitudinal fold lines and wherein said sections divided by said second and fourth longitudinal fold lines are foldable in a second rotational direction about the respective second and fourth longitudinal fold lines, and wherein said first rotational direction is opposite to said second rotational direction.

11. The board of claim 10, wherein said fold lines further comprise a plurality of transverse fold lines perpendicular to said longitudinal fold lines and said board is foldable or unfoldable about successive transverse fold lines in opposite directions.

* * * * *